United States Patent [19]

Hayashi

[11] Patent Number: 4,506,716

[45] Date of Patent: Mar. 26, 1985

[54] PENCIL SHARPENER

[75] Inventor: Hirro Hayashi, Fussa, Japan

[73] Assignee: Yumi Tsukuni, Tokyo, Japan; a part interest

[21] Appl. No.: 436,420

[22] Filed: Oct. 25, 1982

[30] Foreign Application Priority Data

Oct. 29, 1981 [JP] Japan ..... 56-172129
Jul. 31, 1982 [JP] Japan ..... 57-132956

[51] Int. Cl.[3] ..... B43L 23/00

[52] U.S. Cl. ..... 145/3.5; 145/3.31; 145/3.6; 145/3.8

[58] Field of Search ..... 145/3.1, 3.31, 3.5, 145/3.6, 3.61, 3.8

[56] References Cited

U.S. PATENT DOCUMENTS

| | | | |
|---|---|---|---|
| 521,744 | 6/1894 | Veazie | 145/3.5 |
| 1,779,910 | 10/1930 | Kisson | 145/3.5 |
| 1,887,422 | 11/1932 | Oulton | 145/3.61 |
| 2,130,370 | 9/1938 | Spooner | 145/3.5 |
| 2,702,022 | 2/1955 | Fors | 145/3.8 |
| 4,158,912 | 6/1979 | Erdmann | 145/3.31 |

FOREIGN PATENT DOCUMENTS

| | | | |
|---|---|---|---|
| 618308 | 9/1935 | Fed. Rep. of Germany | 145/3.5 |
| 964034 | 5/1957 | Fed. Rep. of Germany | 145/3.5 |
| 10154 | of 1907 | United Kingdom | 145/3.6 |
| 10200 | of 1910 | United Kingdom | 145/3.6 |
| 162011 | 4/1921 | United Kingdom | 145/3.5 |

*Primary Examiner*—Frederick R. Schmidt
*Assistant Examiner*—J. T. Zatarga
*Attorney, Agent, or Firm*—Frishauf, Holtz, Goodman and Woodward

[57] ABSTRACT

A pencil sharpener comprises a tapered pencil-insertion cutting blade. The said blade and/or pencil-insertion bore is disposed so that a taper angle of said blade on the rear side of said sharpener with respect to an axis of a pencil may be smaller than a taper angle of said bore, and so that an end portion of said blade on the rear side of said sharpener may be sited at a distance from a cut surface of the pencil in a direction of the rear side of said sharpener.

20 Claims, 50 Drawing Figures

PENCIL SHARPENER

BACKGROUND OF THE INVENTION

The present invention relates to a pencil sharpener including a blade, more particularly to a pencil sharpener which has a simple structure and which can sharpen a soft wood and a hard lead of a pencil simultaneously in a pointed and fine state by the use of a plate blade.

With regard to a conventional pencil sharpener in which a plate blade is employed, as shown in FIGS. 1 to 3, a body 1 of the sharpener is provided with a conical pencil-insertion bore 2 having a suitable taper angle to an axis of a pencil to be sharpened and a blade-bearing surface 3 having a suitable width disposed along the bore 2, and one plate blade 4 is secured on the surface 3 by means of a screw. In this constitution of the sharpener, however, when used, the blade 4 bites into a wood and a lead of the pencil, which are different in hardness, at the same depth. Therefore, the wood portion near to the lead tends to be ripped off the pencil and the lead tends to be broken, further a sharpened surface of the pencil is liable to be rough, and it is thus very difficult to sharpen the pencil in a finely pointed state by the conventional one. This is evidenced by the fact that there is sold a new sharpener having two pencil-insertion bores which are each provided with a blade and which are different in taper of each blade, one bore serving to sharpen a wood only; another bore serving to sharpen a lead only (manufactured by KUM in West Germany, trade name: Automatic 2).

Further, in the conventional pencil sharpener, the blade is secured to the body of the sharpener by means of a screw or the like. Therefore, the angle of the blade with respect to the bore cannot be adjusted. As improved types, there are suggested the structure that a prolonged orifice is provided along a longitudinal direction of a blade and the blade is fixed by a screw slidably in a forward and a backward directions (Japanese Utility Model Publication No. 29598/1980) and the structure that a knob having a spirally upward guide surface on the rear side of a sharpener body is disposed so that the whole of a blade may be moved upward and downward (Japanese Utility Model Publication No. 46554/1980). In each of these devices, however, the blade is supported at an angle approximately equal to the taper angle of a pencil-insertion bore and still bites into a wood and a lead of a pencil at the same depth. Therefore, they cannot eliminate the above-mentioned drawbacks that the wood and the lead of the pencil are difficult to be simultaneously sharpened in a fine state by one blade, though they permit sharpening pencils having a variety of sizes.

Functions required for a pencil sharpener are (1) being able to sharpen a pencil smoothly and finely, (2) being able to sharpen a lead of the pencil to a desired thickness, (3) being able to prevent over-sharpening of the pencil, and (4) being able to sharpen the pencil in a fine and pointed state. However, none of conventional pencil sharpeners have these functions at all.

For example, the pencil sharpeners mentioned above and shown in FIGS. 1 to 3 do not have the preceding functions 1 to 4. Further, the pencil sharpeners described in Japanese Utility Model Nos. 29598/1980 and 46554/1980 do not have the functions 1, 3 and 4 above, and cannot carry out a fine adjustment of the thickness of a lead with regard to the function 2 above, though being able to make a rough adjustment thereof.

Lately, there has been disclosed an electric pencil sharpener in which a blade is fixed at such an angle as the edge of the blade bite more into a conical bore of the sharpener on the rear side thereof (Japanese Utility Model Provisional Publication No. 81095/1980). However, this pencil sharpener can sharpen a pencil finely but has no functions 2 and 3 mentioned above.

FIG. 4 schematically exhibits a typical structure of a pencil sharpener having a spiral cutter. In the drawing, reference numeral 11 is a body of the pencil sharpener, numeral 12 is a pencil-insertion bore, 14 is a blade (which rotates in an arrow direction in the drawing), 16 is a stopper and symbol P is a pencil. When the sharpener is used, the pencil hits against the stopper at the tip of the lead. That is to say, the pencil can be sharpened to a desired thickness of the lead by moving it in a right and a left directions shown by an arrow symbol in the drawing.

In this structure, over-sharpening can be prevented by the engagement of the tip of the lead of the pencil P with the stopper 16, but on the contrary, the tip of the lead cannot be brought into contact with the blade and thus cannot be pointedly sharpened. Further, the fixation of the stopper 16 makes the structure of the pencil sharpener complicated and also makes the pencil sharpener itself expensive.

As understood from the above, none of the conventional pencil sharpeners have the four functions at all, and if it is attempted that all of them are satisfied, the structure of the pencil sharpener will be very intricate, which will require much labor for the manufacture, and the sharpener itself will be expensive.

SUMMARY OF THE INVENTION

An object of the present invention is to provide a pencil sharpener which is capable of sharpening a wood and a lead of a pencil simultaneously and finely by the use of one blade, and, if desired, a pencil sharpener which is further simple in the structure and which satisfies all of the four functions above.

That is to say, the present invention is directed to a pencil sharpener having a pencil-insertion bore and a plane blade, in which the blade and/or the pencil-insertion bore is disposed so that a taper angle of the blade on the rear side of the sharpener with respect to an axis of a pencil may be smaller than a taper angle of the bore, and so that an end portion of the blade on the rear side of the sharpener may be sited at a distance from a cut surface of the pencil in a direction of the rear side of the sharpener.

The cause of bad simultaneous sharpening of a wood and a lead of a pencil is that the edge of a blade bites into the wood and the lead, which are different in hardness, to an approximately similar depth, and the soft wood is cut smoothly, but the hard lead is difficult to be sharpened. Therefore, it is necessary that the blade and/or the pencil-insertion bore of the sharpener is disposed so that the edge of the blade may bite deeply into the soft wood but bite shallowly the lead. The inventor of the present application has made researches with zeal from the viewpoints of the above fundamental notion and at least has reached the completion of the present invention.

BRIEF DESCRIPTION OF THE DRAWINGS

FIG. 1 is a perspective view showing the pencil sharpener, FIG. 2 is a sectional view taken along the line X—X in FIG. 1, and FIG. 3 is an exploded perspective view of the pencil sharpener in FIG. 1;

FIG. 33 is a view explaining the principle on the basis of the relation between a taper angle of a pencil-insertion bore and a blade, and FIG. 34 is a view explaining that the effect of the present invention is obtained by a gradual reduction in an effective circumference of a pencil-insertion bore;

DETAILED DESCRIPTION

Figure 1:
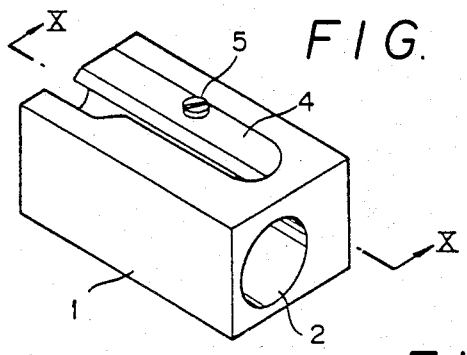
FIGS. 1 to 3 show one example of a conventional pencil sharpener.
Figure 2:
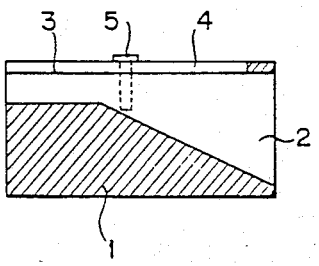
Figure 3:
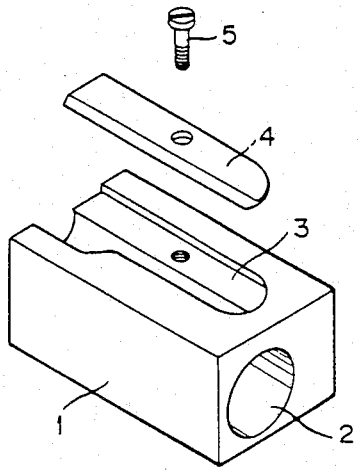
Figure 4:
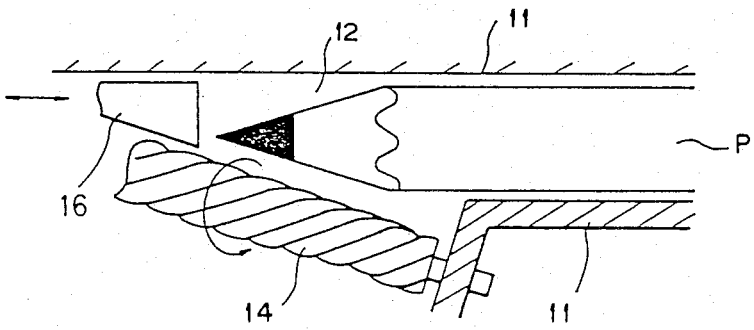
FIG. 4 is a schematic view showing the body portion of a conventional pencil sharpener including a spiral cutter.
Figure 5:
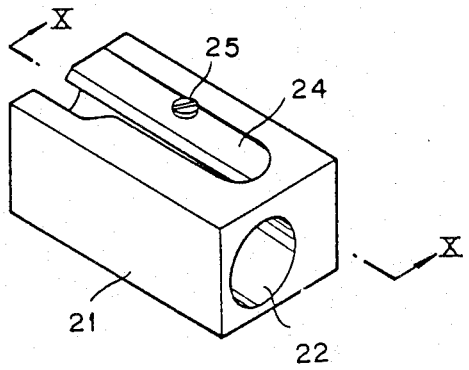
FIG. 5 is a perspective view showing a first example.
Figure 6:
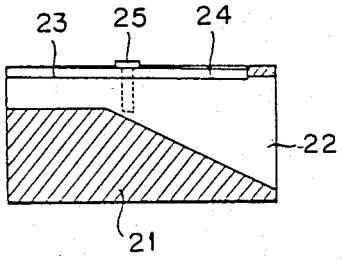
FIG. 6 is a sectional view taken along the line X—X in FIG. 5.
Figure 7:
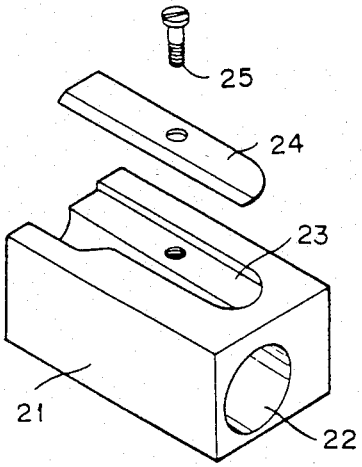
FIG. 7 is an exploded perspective view of the pencil sharpener in FIG. 5.

In the drawings the following reference numerals designate the following parts:

1, 11, 21, 31, 41, 51, 61, 71, 81, 91, 101, 111, 121, 131, 141, 151, 161, 171, 181, 191, 201 . . . Body

2, 12, 22, 32, 42, 52, 62, 72, 82, 92, 102, 112, 122, 132, 172, 182, 192, 202 . . . Pencil-insertion bore

**122*a*** . . . Portion for adjusting a taper of the pencil-insertion bore

3, 23, 33, 43, 53, 63, 73, 83, 103, 123, 203 . . . Blade-bearing surface

4, 14, 24, 34, 44, 54, 64, 74, 84, 94, 104, 114, 124, 134, 174, 194, 204 . . . Blade

114' . . . Edge of the blade

5, 25, 35, 65, 75, 85, 95, 105, 125, 135, 175, 205 . . . Screw

16 . . . Stopper

46, 56, 86, 106 . . . Screw for taper adjustment

57, 77, 97 . . . Dial for taper adjustment

98, 188 . . . Casing body **98*a*, 188*a*** . . . Lid

128, 138, 148, 158, 168, 178, 198 . . . Slit

**98*b*** . . . Opening for insertion of a pencil

109, 129, 139, 149, 159, 169, 179, 189, 199, 209 . . . Grip for adjusting a taper of the pencil-insertion bore

**129*a*, 139*a*, 149*a*, 159*a*, 169*a*** . . . Screw for adjusting a taper of the pencil-insertion bore

190 . . . Graduation indicator

200 . . . Spring bearing surface

206 . . . Screw for fixing spring

208 . . . Spring for taper adjustment of pencil-insertion bore

P . . . Pencil A . . . Axis of the pencil

B . . . Level line of the blade

C . . . Level line of the pencil-insertion bore a . . . Intersection between the level line of the blade and the level line of the pencil-insertion bore b . . . Intersection between the level line of the pencil-insertion bore and the axis of the pencil In the first place, reference will be made to an example with regard to a pencil sharpener which is equipped with all the functions other than the previous function 2:

Referring now to FIGS. 5 to 8 of the accompanying drawings, reference numeral 21 is a body of a pencil sharpener, numeral 22 is a pencil-insertion bore, 23 is a blade-bearing surface, 24 is a blade and 25 is a screw for fixing the blade.

Figure 8:
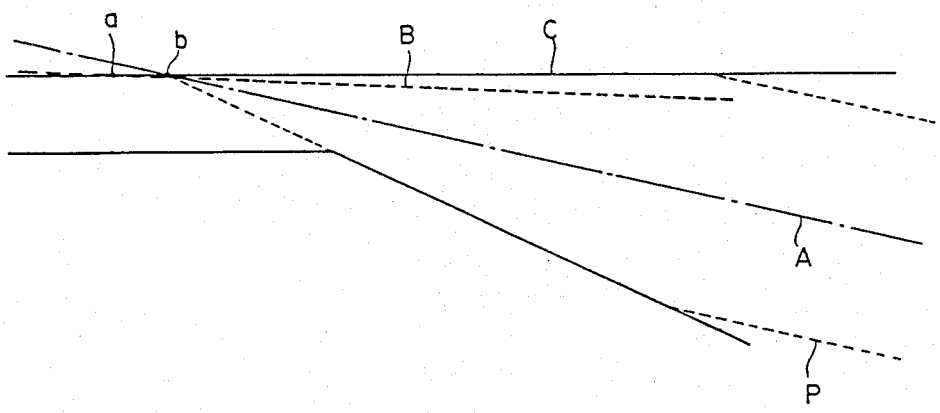
FIG. 8 is a diagram explaining an arrangement relation among a blade, a pencil-insertion bore and a pencil in FIG. 5.
Figure 9:
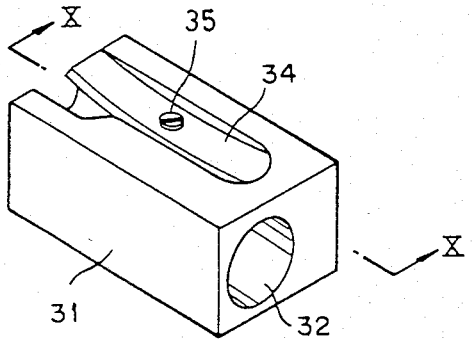
FIG. 9 is a perspective view showing a second example.
Figure 10:
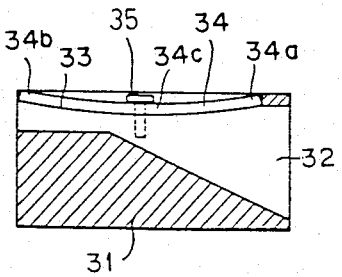
FIG. 10 is a sectional view taken along the line X—X in FIG. 9.
Figure 11:
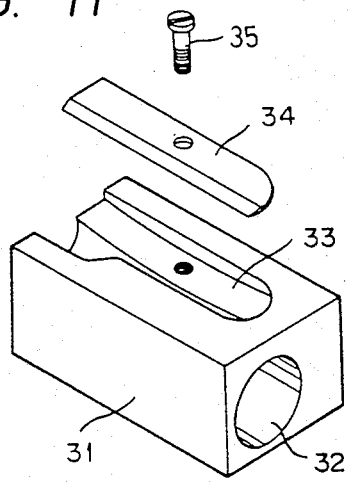
FIG. 11 is an exploded perspective view of the pencil sharpener in FIG. 9.

The blade-bearing surface is formed so that a taper angle thereof may be somewhat smaller than a taper angle of the bore 22 with respect to an axis 4 of a pencil P, and the blade 24 bites into a surface to be sharpened of the pencil P at a suitable depth in the bore-inlet portion, i.e. on the front side of the pencil sharpener, and the cutting depth of the blade becomes less gradually toward the portion of the sharpener opposite to the bore-inlet portion, i.e. rear portion of the sharpener, and becomes minimal in the portion where the tip of the lead of the pencil P is sited. In other words, as shown in FIG. 8, the constitution is made so that an intersection a between a level line B (a thick dotted line) of the blade 24 and a level line C (a solid line) of the pencil-insertion bore 22 may be placed at a distance from an intersection b between the line C and an axis A (a broken line) of the pencil P (a thin dotted line) in a direction of the rear portion (in a left direction in the drawing).

According to the above constitution, when the pencil P is sharpened, the soft wood is deeply cut and the hard lead is shallowly cut, so that the wood and the lead which are different in hardness can be sharpened simultaneously with the result that a state of the sharpened surface is lustrous and the tip of the lead can be finely pointed. Further, when the sharpening of the lead has finished, the pencil is not sharpened any more and becomes an idle condition, as a result the over-sharpening of the pencil can be prevented.

Figure 12:
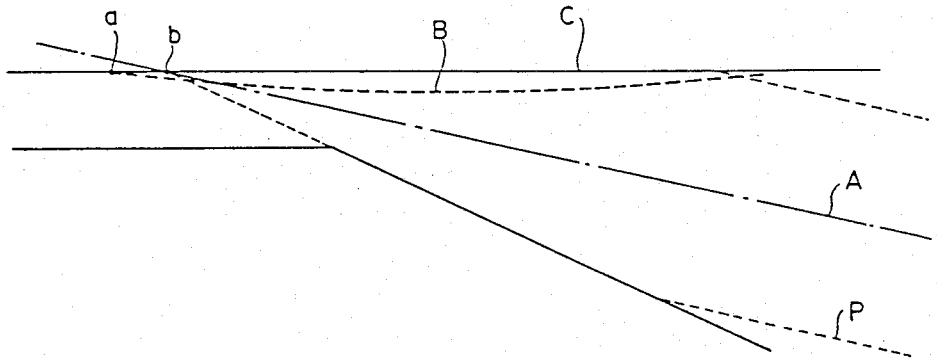
FIG. 12 is a diagram explaining an arrangement relation among a blade, a pencil-insertion bore and a pencil in FIG. 9.

In a second example of the present invention shown in FIGS. 9 to 12, a blade is secured curvedly in a longitudinal direction thereof, and reference numeral 31 is a body of a pencil sharpener, 32 is a pencil-insertion bore, 33 is a blade-bearing surface, 34 is a blade and 35 is a screw for fixing the blade. In this structure, the blade-bearing surface 33 is curved most deeply in the approximately central portion thereof, and the blade 34 can be curved by fixing the screw 35 to the blade-bearing surface 33 through the blade 34 against the elasticity thereof so as to cut into a pencil gradually deeply from the front portion 34*a* toward the approximately central portion 34*c* of the blade 34, most deeply in the approximately central portion 34*c*, gradually shallowly toward the rear portion 34*b* of the blade 34 and most shallowly in the portion where the tip of the lead is sited. In other words, as shown in FIG. 12, the constitution is made so that an intersection a between a level line B (a thick dotted line) of the blade 34 and a level line C (a solid line) of the pencil-insertion bore 32 may be placed at a distance from an intersection b between the line C and an axis A (a broken line) of the pencil P (a thin dotted line) in a direction of the rear portion (in a left direction in the drawing).

According to the above constitution, when the pencil P is sharpened, the soft wood can be sharpened finely and precisely, and the wood and the lead of the pencil which are different in hardness can be pointed simultaneously and finely.

Figure 13:
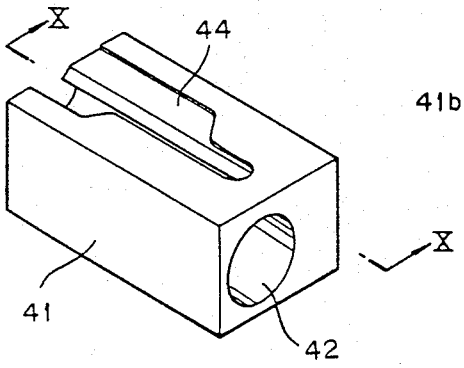
FIG. 13 is a perspective view showing a third example.
Figure 14:
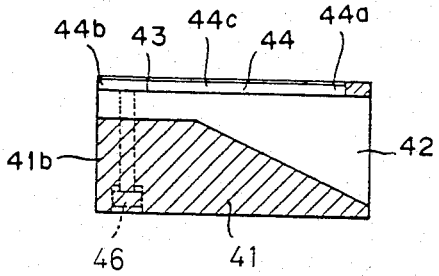
FIG. 14 is a sectional view taken along the line X—X in FIG. 13.
Figure 15:
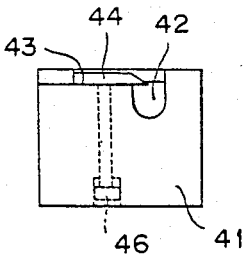
FIG. 15 is a side view of the pencil sharpener in FIG. 13.

In a third example shown in FIGS. 13 to 15, a taper angle of a blade is adjustable, and reference numeral 41 is a plastic body of a pencil sharpener, 42 is a pencil-insertion bore, 43 is a blade-bearing surface and 44 is a blade. The blade 44 is secured adhesively on the blade-bearing surface 43 on the front side 44*a* of the body but is not fixed thereon on the rear side 44*b* thereof, and the rear side 44*b* of the blade 44 is provided with a screw 46 for adjusting a taper of the blade by pressing up against the under surface of the blade 44 on the rear side 44*b* thereof. Therefore, rotation of the screw 46 permits pushing up the rear side 44*b* of the blade 44 against the elasticity thereof.

According to the above constitution, even if the size of the body 41 and the blade 44 as well as the position for securing the blade 44 is inaccurate, rotary operation of the screw 46 permits suitably adjusting the taper angle of the blade 44 on the rear side 44*b* thereof with regard to an axis of a pencil so that the blade 44 may bite the cut surface of the pencil P gradually shallowly toward the rear side 44*b* from the approximately central portion of the blade and most shallowly in the portion where the tip of the blade is sited. Further, since the blade 44 can adhesively be fixed to the blade-bearing surface 43 without a screw, it is needless to form in the blade an opening into which a screw is inserted, therefore the blade to be used may be narrow in width, which thus leads to reduction in cost of the blade. Also, it is possible to miniaturize a pencil sharpener body by the use of the narrow blade.

As mentioned above, the depth of the blade which bites the cut surface of the pencil has a great influence on performance of the sharpening of the pencil, and especially with regard to the depth of the blade which bites into the tip of the lead, even a very minute deviation as much as 0.1 mm or less renders, impossible, acquisition of a good sharpening condition having a luster and pointed tip, therefore inaccurate manufacture of the body and the blade must be avoided as much as possible. In the case that the body is made of a metal, much attention must be paid to a manufacturing process of the bodies and an assembly process of the sharpeners, and when plastics are used for the bodies, dimensional accuracy tends to be bad, though cost of the products can be reduced. Therefore, it is noticeably difficult to obtain a pencil sharpener capable of providing a good and accurate sharpening condition. With regard to a pencil sharpener having a plate blade, in the case that its body is made of a metal, the sharpening performance of the pencil sharpener is not so bad but it is expensive; in the case that its body is made of plastics, a good and accurate cutting state cannot be obtained, though it is inexpensive. Anyway, it is not too much to say that users recognize that this type of pencil sharpener cannot provide any fine and accurate cutting state.

However, according to the constitution in which the taper angle of the blade and/or the pencil-insertion bore is adjustable, it is possible to make fine adjustment so that the blade may be sited at the best position with respect to the cut surface of the pencil, as a result a good and accurate cut surface of the pencil can be obtained in the case of a metallic body as well as a plastic body, even if dimentional accuracy of the body or the blade is unreliable, or even if some errors occur at the time of an assembly operation.

In this connection, although the blade 44 in this example is disposed along the taper of the pencil-insertion bore 42, as in the case of a conventional pencil sharpener, the member may be disposed without regard to the taper of the bore 42, or may be secured on the blade-bearing surface 43 by means of a screw, as in the fist and second examples above.

Figure 16:
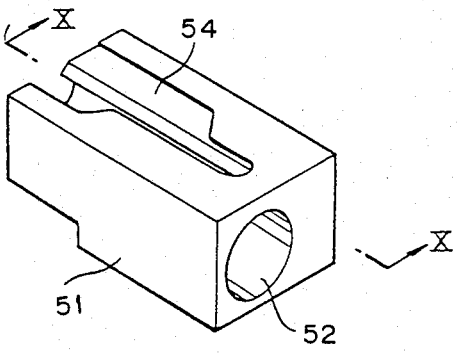
FIG. 16 is a perspective view showing a fourth example.
Figure 17:
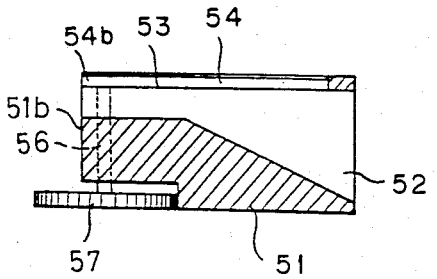
FIG. 17 is a sectional view taken along the line X—X in FIG. 16.
Figure 18:
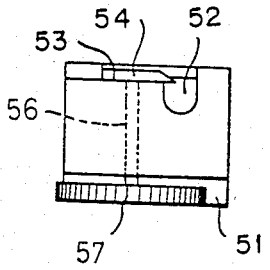
FIG. 18 is a side view of the pencil sharpener in FIG. 16.

In a fourth example shown in FIGS. 16 to 18, the taper angle of a blade can be suitably adjusted, and reference numeral 51 is a body of a pencil sharpener, numeral 52 is a pencil-insertion bore, 53 is a blade-bearing surface, 54 is the blade which is secured on the blade-bearing surface as in the third example. The body 51 is provided on the rear side 51*b* thereof with a dial 57 having a screw 56 for pressing up against the under surface of the blade 54 on the rear side 54*b* of the blade, and adjustment of the taper angle of the blade can be made by rotating the dial 57 and by thus pressing up the blade 54 on the rear side 54*b* against its elasticity. At the time of sharpening a pencil, therefore, a user can adjust the taper of the blade 54 to a desired angle by rotating the dial 57 while observing a sharpening state of the pencil, and the sharpener of this type can provide a good cut surface for a prolonged lifetime even if the blade 54 is worn to a certain degree.

Figure 19:
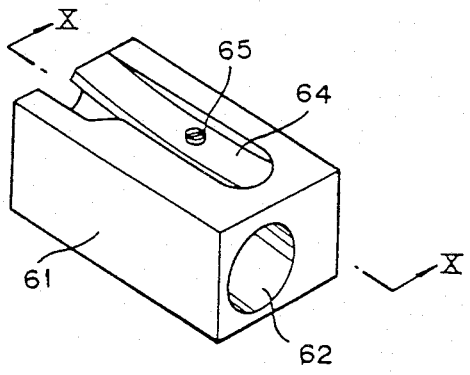
FIG. 19 is a perspective view showing a fifth example.
Figure 20:
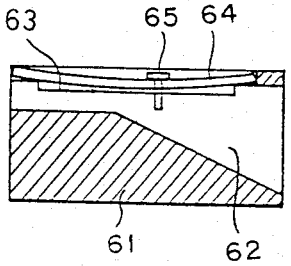
FIG. 20 is a sectional view taken along the line X—X in FIG. 19.
Figure 21:
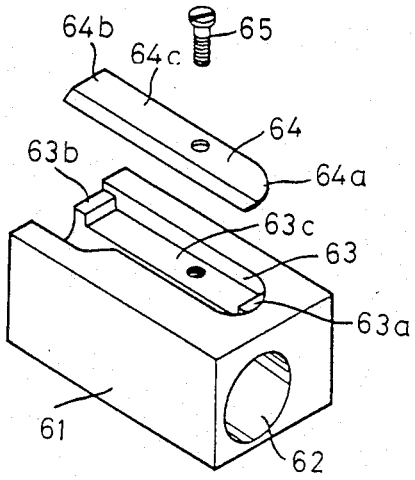
FIG. 21 is an exploded perspective view of the pencil sharpener in FIG. 19.

A fifth example shown in FIGS. 19 to 21 is directed to an embodiment by which the taper angle of a blade can be adjusted by means of a securing screw, and reference numeral 61 is a body of a pencil sharpener, numeral 62 is a pencil-insertion bore, 63 is a blade-bearing surface, 64 is the blade and 65 is the screw. The blade-bearing surface 63 is provided with a recess 63*c* between supporting portions 63*a* and 63*b* on the front and rear sides, respectively, of the blade-bearing surface, and the blade 64 can be secured curvedly on the blade-bearing surface 63 by fastening the screw against elasticity of the blade 64 so that the front portion 64*a* and the rear portion 64*b* of the blade 64 may be supported on the blade supporting portions 63*a* and 63*b* and a central portion 64*c* may be close to the recess 63*c* of the blade-bearing surface 63. Accordingly, the taper of the cutting blade can be adjusted so as to bite suitably in the cut surface of the pencil, as in the second example above, and the screw 65 and serve to secure the blade 64 on the blade-bearing surface and to adjust the taper angle of the blade. In this case, the recess 63*c* of the blade-bearing surface 63 may take any shape, so long as it permits the adjustment of the taper of the blade 64.

Figure 22:
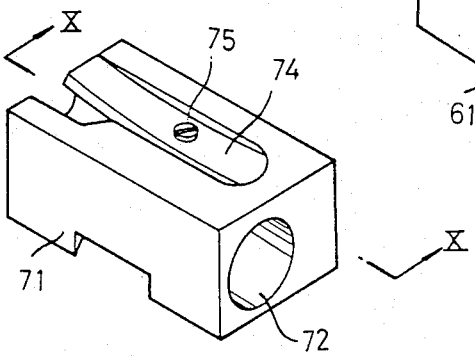
FIG. 22 is a perspective view showing a sixth example.
Figure 23:
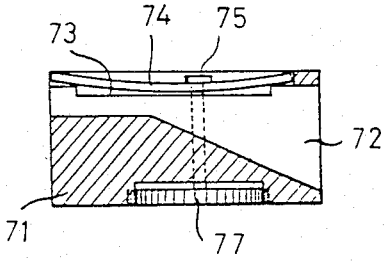
FIG. 23 is a sectional view taken along the line X—X in FIG. 22.
Figure 24:
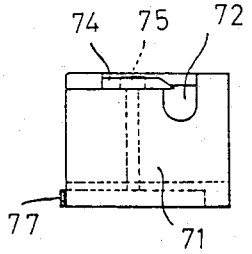
FIG. 24 is a side view of the pencil sharpener in FIG. 22.

A sixth example shown in FIGS. 22 to 24 is directed to an embodiment in which the taper angle of a blade can be suitably adjusted, and reference numeral 71 is a body of a pencil sharpener, numeral 72 is a pencil-insertion bore, 73 is a blade-bearing surface, 74 is the blade and 75 is a screw. The blade-bearing surface 73 is provided with a recess 73*c* as in the fifth example, and the screw 75 is screwed in the body 71 so that the blade 74 may be secured on the cutting blade-bearing surface 73. The tip of the screw 75 is projected out from the under surface of the body 71 and is further connected to a dial 77. Adjustment of the taper of the blade to a suitable angle can be carried out by rotating the dial 77, as in the above example.

Figure 25:
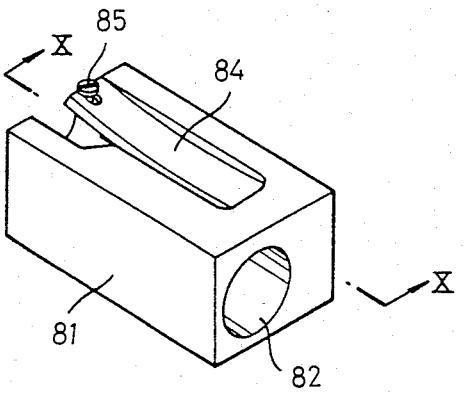
FIG. 25 is a perspective view showing a seventh example.
Figure 26:
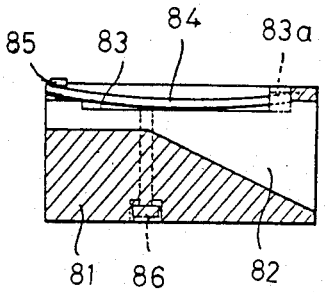
FIG. 26 is a sectional view taken along the line X—X in FIG. 25.
Figure 27:
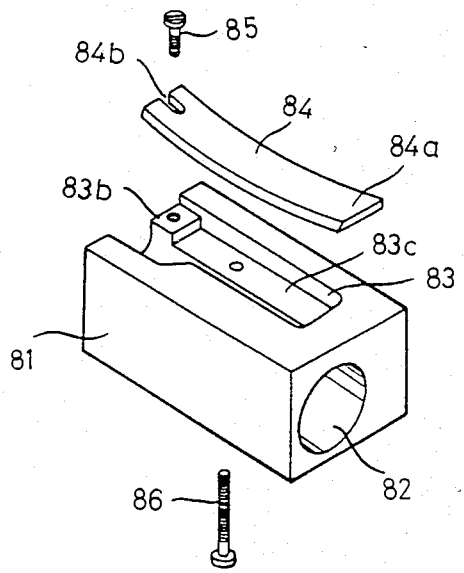
FIG. 27 is an exploded perspective view of the pencil sharpener in FIG. 25.

A seventh example shown in FIGS. 25 to 27 is directed to an embodiment in which a previously longitudinally curved blade is employed, and reference numeral 81 is a body of the pencil sharpener, numeral 82 is a pencil-insertion bore, 83 is a blade-bearing surface, 84 is a blade and 85 is a securing screw. The blade 84 is formed so as to have a slightly more curvature than a suitable curvature and is formed on the rear side thereof with a cutout groove 84*b*. The blade-bearing surface 83 is provided on the front side thereof with a groove 83*a* for supporting a front side 84*a* of the blade 84, provided on the rear side thereof with a supporting portion 83*b*, and provided in the center thereof with a recess 83*c*, as in the fifth and sixth examples above. The screw 86 is threaded in the body 81 from the bottom thereof so that the tip of the screw 86 can be projected out from the approximately central portion of the recess 83 of the blade-bearing surface 83. A pencil-insertion side, i.e. front side 84*a* of the blade 84 is mounted in a groove 83*a* of the blade-bearing surface, and the screw 85 is mounted in the cutout groove 84*b* of the blade 84 to fix the latter on the supporting portion 83*b* of the blade-bearing surface. Adjustment of the taper of the blade 84 to a desired angle can be carried out by rotating the screw 86, and when rotated, the tip of the screw is projected out from the recess 83*c* of the blade-bearing surface and the screw pushes up the nearly central portion 84*c* of the blade 84 against elasticity of the blade 84 so as to separate from the recess 83*c* of the bearing surface 83. That is to say, in contrast to the fifth example in which the taper adjustment can be carried out by curving the blade, this embodiment is characterized in that the taper adjustment can be accomplished by deforming the previously curved blade toward a plate form. In this connection, a dial for adjusting the taper may be fixed to the screw 86 to facilitate the taper adjustment of the cutting blade 84, as in the fourth example. Needless to say, the taper adjustment of the blade 84 can be made by the screw 85 alone.

Figure 28:
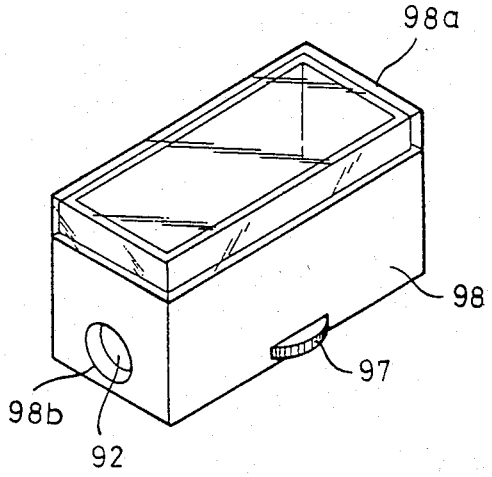
FIG. 28 is a perspective view showing an eighth example.
Figure 29:
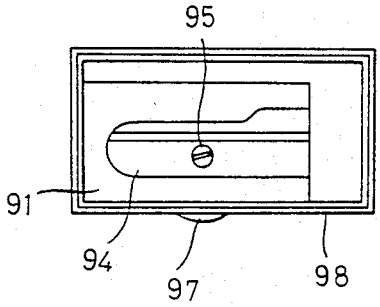
FIG. 29 is a plan view of the encased pencil sharpener, but it has no lid.

An eighth example shown in FIGS. 28 to 29 is directed to an embodiment in which disposal of pencil shavings is considered by attaching a casing to a pencil sharpener body, and reference numeral 98 is a casing body for receiving the pencil shavings, numeral 98*a* is a transparent plastic lid which is mounted on the casing body 98 and numeral 98*b* is an opening for allowing a pencil to be inserted. Inside the casing body 98, there is disposed a mechanism of the above-mentioned sixth example. In these drawings above, reference numeral 91 is a body of the pencil sharpener, numeral 92 is a pencil-insertion opening, 94 is a blade, 95 is a screw and 97 is a dial for adjusting the taper of the blade. Taper adjustment of the blade 94 can easily be carried out by rotating the dial 97 which is exposed outside the casing body 98, and the pencil shavings can be received in the casing body 96, so that the scatter of them will be prevented. Further, since the lid 96*a* is transparent, the sharpening operation can be carried out while observing a sharpening state or an amount of collected pencil shavings. The above embodiment includes the box-like casing and the pencil sharpener therein of the sixth example above, but, needless to say, any shape of the casing is acceptable and a pencil sharpener other than the illustrated one can be included in the casing.

Figure 30:
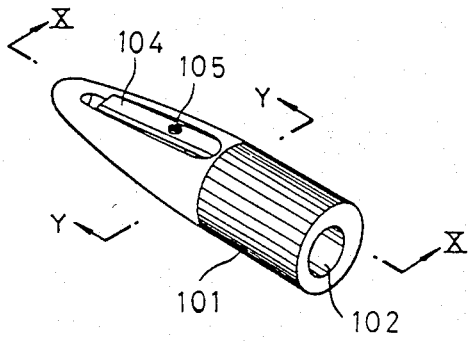
FIG. 30 is a perspective view showing a ninth example.
Figure 31:
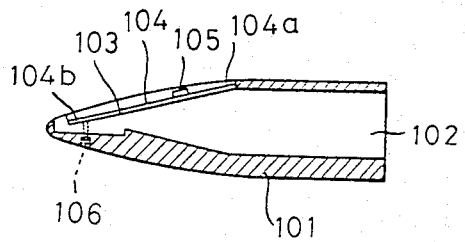
FIG. 31 is a sectional view taken along the line X—X in FIG. 30.
Figure 32:
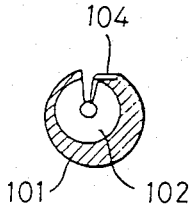
FIG. 32 is a sectional view taken along the line Y—Y in FIG. 30.

A ninth example shown in FIGS. 30 to 32 is directed to an embodiment in which a pencil sharpener is formed integrally with a pencil cap, and reference numeral 101 is a plastic body, numeral 102 is a pencil-insertion bore, 103 is a blade-bearing surface, 104 is a blade and 105 is a securing screw. The body 101 has on the periphery thereof a rough surface for slip resistance, and the same screw 106 for adjusting a taper as in the third example is disposed on the rear side of the body. Therefore, taper adjustment of the blade can be carried out by rotating the screw 106. That is to say, when it is rotated, the rear side 104*b* of the blade is pushed up and the blade is set to the cut surface of a pencil at a suitable depth so as to cut into the pencil surface gradually shallowly toward the rear side 104*b* of the blade and most shallowly at the position where the tip of a pencil lead is sited. Therefore, even if dimensional accuracy of the body 101 or the blade 104 is unreliable, the blade 104 can be set to the normal position where a fine and accurate sharpening effect can be obtained, and breakage of the pencil lead can be prevented because the lead is protected in the body 101, and when required, a user can sharpen a pencil at once.

Next, reference will be made to a pencil sharpener having all of the above-mentioned four functions, as follows:

Such a pencil sharpener has a construction in which a blade is disposed on a body having a pencil-insertion bore, and a slit is provided along the pencil-insertion bore on the rear side of the body rather than on the front side thereof so as to separate the sharpener body into two portions which can be moved toward or away from each other.

Figure 33:
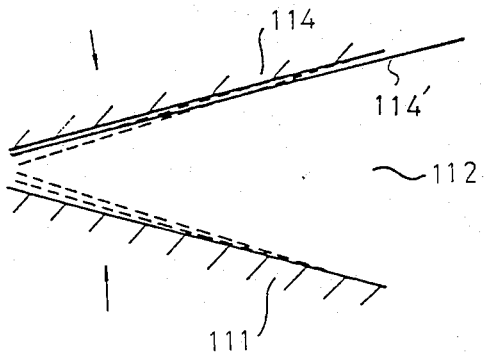
FIGS. 33 and 34 show the principle of a pencil sharpener having four functions.
Figure 34:
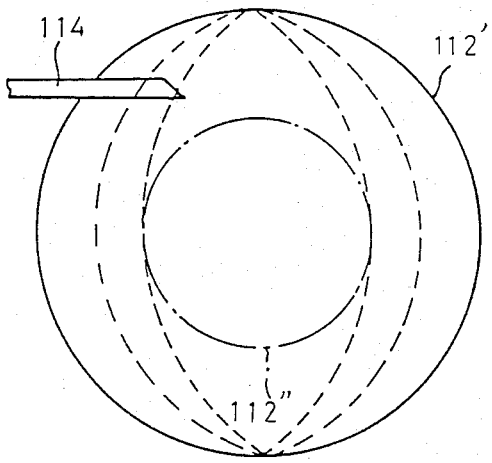

The operating principle of this type of pencil sharpener will be described referring to FIG. 33 (in which numeral 114' represents an edge of a blade) and FIG. 34 as follows: If a taper angle of a pencil-insertion bore 112 is altered on the rear side of the body in a direction of the arrows in FIG. 33, the shape 112' of the pencil-insertion bore will be gradually deformed to an oval. As a result, a virtual area (an effective circumference) of the pencil-insertion bore 112'' will be gradually reduced, and the edge 114' of the blade 114 will be separated gradually from the lead tip of the pencil. Accordingly, for the purpose of facilitating the deformation of the shape 112' of the pencil-insertion bore to a desired oval, an embodiment of the present invention includes a slit for dividing the body into two portions, which are adapted to move toward and away from each other.

When the body of the pencil sharpener takes the above construction, the thickness of the pencil lead can be adjusted optionally by fastening or releasing the slit, and since the blade 114 always bites into the soft wood of the pencil at a suitable depth and shallowly into the hard lead thereof, a smooth sharpening effect can be obtained. On the other hand, if the virtual diameter of the pencil-insertion bore is reduced or enlarged by adjusting suitably the fastening of the slit so as to separate the lead tip of the pencil from the edge of the blade, the lead tip will not be sharpened any more. Accordingly, when a sharpening operation has been completed, the tip of the pencil will be blocked by the wall of the pencil-insertion bore; as a result the pencil will idle, and over-sharpening of the pencil can be prevented.

The slit may be provided at any position of the body including the pencil-insertion bore, and the slit at any position can exhibit a similar effect, because the above-mentioned effective circumference can likewise be reduced or enlarged even by the slit at any position. Further, the slit may extend so as to cut out the rear end wall of the body and to thereby separate it into two portions, or may take a shape such as a prolonged or a shortened opening which does not reach the rear end wall. Furthermore, with regard to length and shape of the slit, no particular limitation is made, the slit having any length and any shape is acceptable, so long as it permits the effective circumference to be gradually reduced or enlarged toward the rear side of the body by fastening or releasing both sides of the pencil-insertion bore.

Generally, the blade is fixed in parallel with the pencil-insertion bore, but in the present invention any limitation need not be made on such a structure, because the taper angle of the pencil-insertion bore can be adjusted suitably.

As a mechanism for separating and closing the two portions of the body on the rear side thereof, a usual fastening structure may be used. For example, the slit is first provided on the rear side of the body and a threaded hole is formed between the two portions of the body separated by the slit, and a screw is threaded into the formed hole. In such a structure, the operation of separating and closing the two portions of the body can be carried out by fastening or releasing the screw. A similar effect can be obtained by nipping the body from both the sides thereof. The screw having a small pich can serve to easily do a fine adjustment, because a moving distance between the two portions of the body by one rotation of the screw is small.

Practically, the adjusting screw takes preferably a dial type for easy operation. More preferably, a part or the whole of the dial is exposed outside the body so as to permit external operation.

Further, it is preferred that the means of separating and closing the above portions is the screw, because it is simple in structure and can do a fine adjustment by a slight rotating operation. However, the means is not limited to the screw, but any means is acceptable, so long as it can provide a similar effect.

Figure 35:
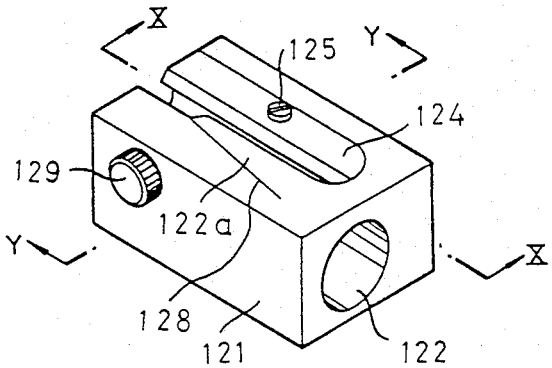
FIG. 35 is a perspective view showing a tenth example.
Figure 36:
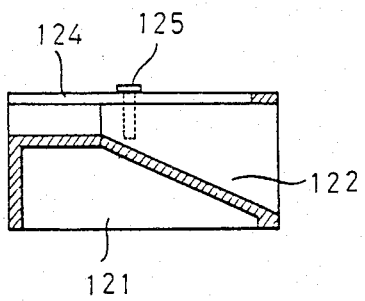
FIG. 36 is a sectional view taken along the line X—X in FIG. 35.
Figure 37:
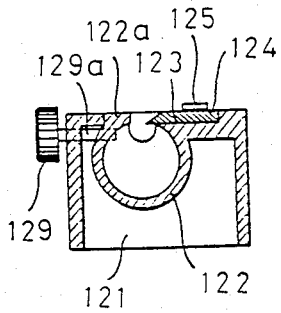
FIG. 37 is a sectional view taken along the line X—X in FIG. 35.
Figure 38:
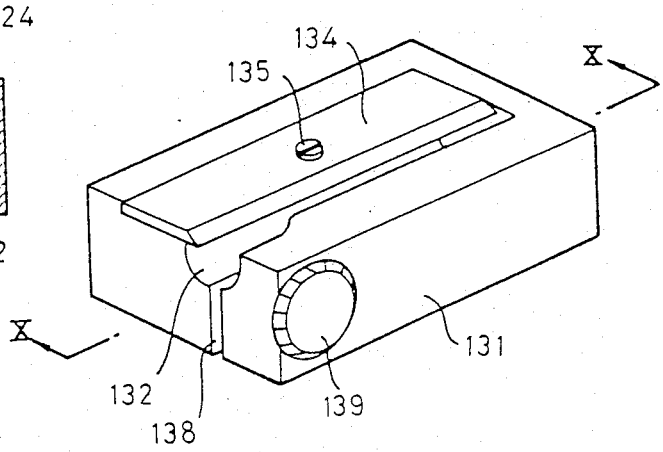
FIG. 38 is a perspective view showing an eleventh example.
Figure 39:
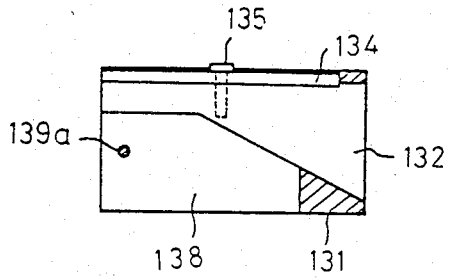
FIG. 39 is a sectional view taken along the line X—X in FIG. 38.
Figure 40:
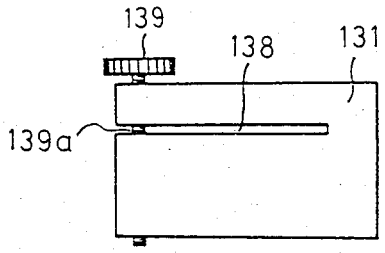
FIG. 40 is a rear view of the pencil sharpener in FIG. 38.
Figure 41:
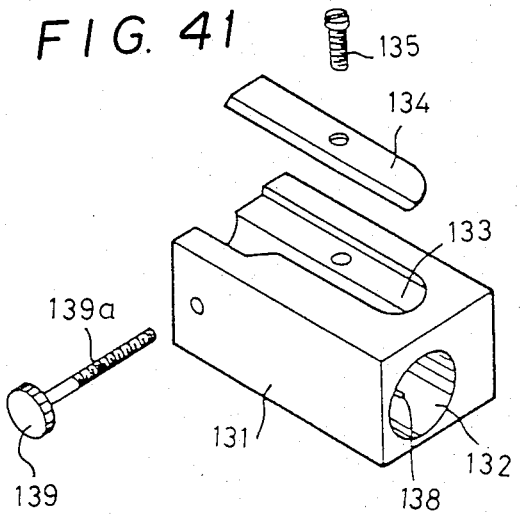
FIG. 41 is an exploded perspective view of the pencil sharpener in FIG. 40.

With regard to the pencil sharpener in which two portions of the body divided by the slit are separated and closed, its example will be described as follows:

A tenth example shown FIGS. 35 to 37 is directed to an embodiment where the taper of a pencil-insertion bore can be adjusted, and reference numeral 121 is a plastic body of a pencil sharpener, numeral 122 is a pencil-insertion bore, 123 is a blade-bearing surface, 124 is a blade and 125 is a securing screw. The pencil-insertion bore 122 has a suitable wall thickness and an approximately conical shape, and the body 121 is separated into two portions by a slit 128 from a suitable position on the side opposite to the blade-bearing surface 123 via a sharpening aperture to a suitable position on the front side of the body 121 and a portion 122*a* for adjusting the taper of the pencil-insertion bore is provided at the position on the side opposite to the blade-bearing surface. And, the body 121 is provided with a grip 129 for adjusting the taper of the pencil-insertion bore, which is equipped with a screw 129*a* capable of pushing the adjusting portion 122*a* toward the blade-bearing surface 123. According to the above consitution, the adjusting portion 122*a* is pushed to the interior of the pencil-insertion bore against elasticity of the plastic by rotating the grip 129 and to thereby change the taper of the pencil-insertion bore 122, whereby the blade 124 can be adjusted so as to bite into the cut surface of the pencil gradually shallowly toward the tip of a pencil lead. Accordingly, a user can adjust the taper of the pencil-insertion bore 122 to a desired angle by rotating the grip 129 while observing the sharpening state of the pencil, and thus a good and accurate sharpening surface can be obtained. That is to say, in contrast to the above-mentioned third and ninth examples in which the taper of the blade can be adjusted, this example contemplates adjusting the taper of the pencil-insertion bore so that the blade may bite into the most suitable position on the cut surface of the pencil. Although the axis of the pencil-insertion bore somewhat deviates, no eccentricity occurs virtually, because its deviation is 0.1 mm or so and the pencil is rotated at the time of the sharpening operation.

In an eleventh example shown in FIGS. 38 to 41, a slit 138 is provided in the portion of a body confronting a sharpening aperture so that the body may be divided into two portions along a longitudinal direction thereof, and a screw 139*a* equipped with a grip 139 for taper adjustment is disposed at a suitable position of the body through the two-divded portions. The effective circumference of the pencil-insertion bore on the rear side of the body can be reduced gradually by the rotation of the screw 139*a*.

Figure 42:
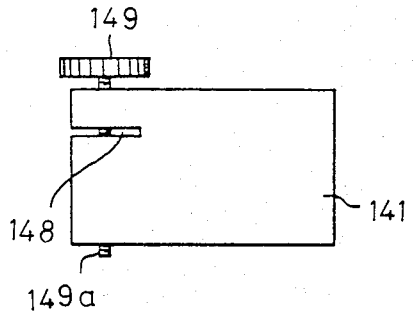
FIG. 42 is a rear view showing a twelfth example.
Figure 43:
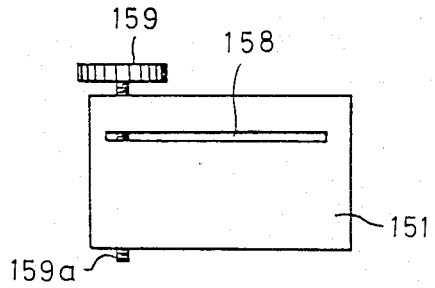
FIG. 43 is a rear view showing a thirteenth example.

In a twelfth example shown FIG. 42, length of the slit is shorter than in the twelfth example. This example including the short slit can exhibit the same effect as in the preceding examples.

According to the above constitution, even if the dimensional accuracy of the body and the blade is unreliable, even if the fixing position of the blade with respect to the blade-bearing surface deviates, or even if the strength of inserting a pencil into the pencil-insertion bore varies, the adjustment of the taper angle of the pencil-insertion bore with regard to the axis of the pencil can be carried out by rotating the screw so that the blade may bite into the cut surface of the pencil gradually shallowly toward the rear side of the body and may bite into it more shallowly at the portion where the lead tip lies.

Although the slit in FIG. 42 is shorter than in the eleventh example, the similar effect can be obtained without any disadvantage.

Figure 44:
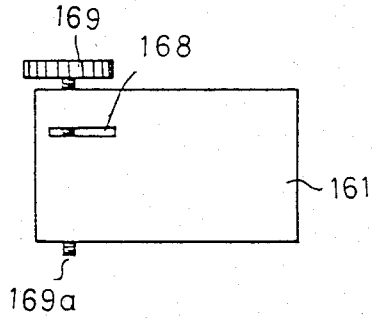
FIG. 44 is a rear view showing a fourteenth example.

In a thirteenth and a fourteenth example shown FIGS. 42 and 44, slits are each provided in the form of a prolonged opening in an approximately central portion of each of the pencil-insertion bores. Also in each of these examples, the diameter of the pencil-insertion bore on the front side of the body is constant, and the effective circumference is adjustable so as to reduce or enlarge gradually toward the rear side of the body. The slit is provided preferably so that the pencil-insertion bore may be divided approximately equally into two portions, because when the slit is sited in such a position, eccentricity occurs hardly. However, even if the slit deviates from the above preferable position to the right or left side thereof, a similar effect can be obtained.

Figure 45:
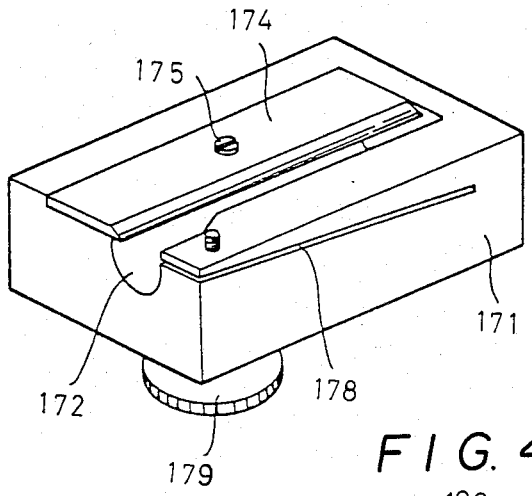
FIG. 45 is a perspective view showing a fifteenth example.

In a fifteenth example shown in FIG. 45, a slit 178 is provided in the side wall of a body 171, and a screw is disposed through the two portions of the body divided by the slit 178. Also in this example, the effective circumference of a pencil-insertion bore can be reduced or enlarged toward the rear side of the body, therefore this example can obtain about the same effect as in the previous examples. In this fifteenth example, the axis of the pencil-insertion bore will be slightly eccentric by changing the taper angle of the pencil-insertion bore, but such an appreciable eccentricity as leads to a disadvantage will not be brought about, because the pencil will rotate at the time of its sharpening operation.

Figure 46:
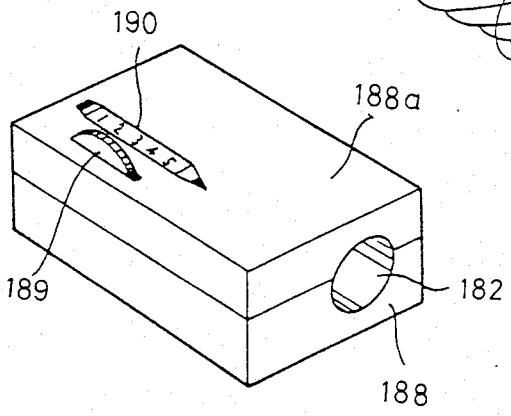
FIG. 46 is a perspective view showing a sixteenth example.

A sixteenth example shown in FIG. 46 is directed to an embodiment in which a casing is disposed for easy disposal of pencil shavings, and reference numeral 188 is a casing body for receiving pencil shavings, numeral 188*a* is a lid which is mounted on the casing body 188 and 190 is a graduation indicator which can be used on adjusting a thickness of a pencil lead. Inside the casing body 188, there is accommodated a pencil sharpener with regard to the present invention, and a dial 189 to which a screw 189*a* is connected is partially exposed from the lid 188*a*. According to this consitution, the fine adjustment of the taper angle of the pencil-insertion bore can be easily carried out by setting the dial to a desired graduation value, and the pencil sharpenings can be received in the casing body 188, whereby their scatter can be prevented. When the lid 188*a* is made of a transparent material, the pencil sharpening operation can be done while observing a sharpening condition and an amount of collected shavings.

Figure 47:
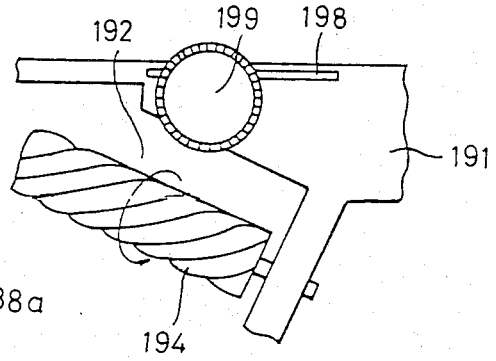
FIG. 47 is a schematic view showing the body portion of the seventeenth example including a spiral cutter.

In a seventeenth example shown in FIG. 47, a prolonged slit 198 is provided in the pencil sharpener body 191 including a spiral cutter 194, along the longitudinal direction of a pencil-insertion bore 192. Also in this example, the effective circumference of the pencil-insertion bore 192 can be reduced gradually by rotating the screw 199, whereby the effect of the invention can be obtained.

Figure 48:
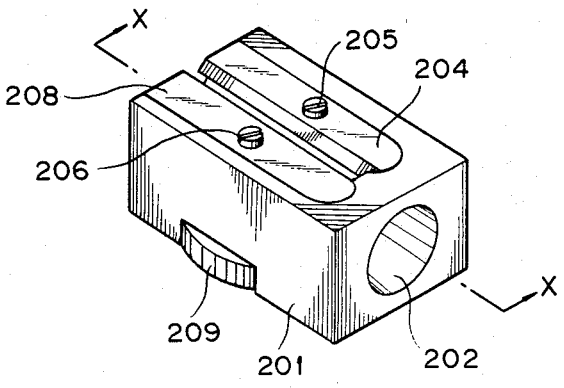
FIG. 48 is a perspective view showing a eighteenth example.
Figure 49:
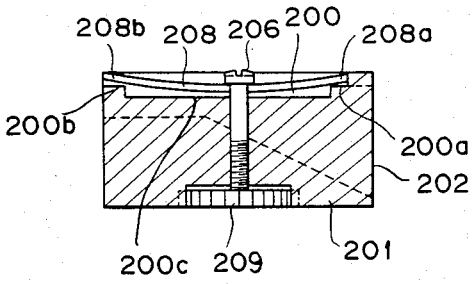
FIG. 49 is a sectional view taken along the line X—X in FIG. 48.
Figure 50:
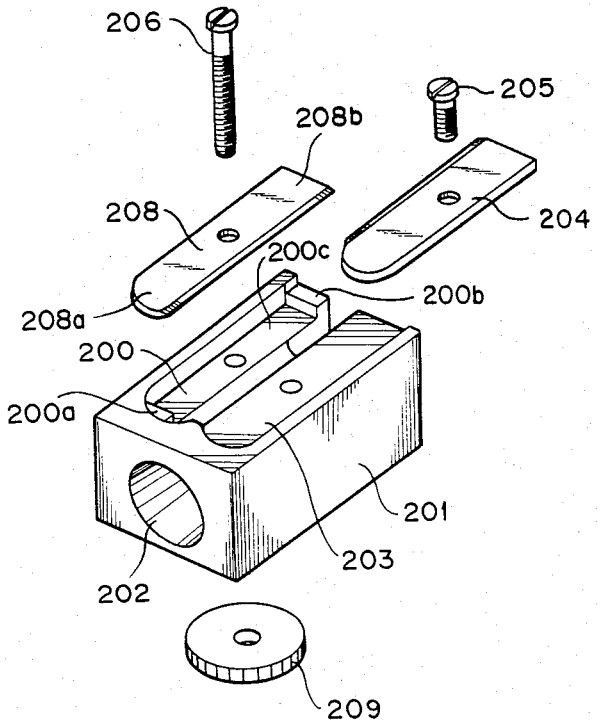
FIG. 50 is an exploded perspective view of FIG. 48.

Example 18 shown in FIG. 48 through FIG. 50 is a specific embodiment of the present invention in which the taper angle of a pencil-inserting bore is made adjustable. In the Figures, 201 designates a body, 202 a pencil-inserting bore, 203 a blade-bearing surface, 204 a blade, 205 a screw for fixation, 206 a screw for fixing a spring, 209 a dial for adjusting taper of the pencil-inserting bore, 208 a spring for adjusting the taper angle of the pencil-inserting bore and 200 a spring-bearing surface. The blade 204 is mounted on the face 203 along the taper of the blade-bearing surface 202 by means of screw 205 whereby it is fixed to the body. On the opposite side of the slit for sharpening, spring-bearing surface 200 is placed for mounting spring 208 for adjusting the taper angle of the pencil-inserting bore. On the spring-bearing surface 200, there are placed supporting portions 200*a* and 200*b*, and recess 200*c* inbetween thereof. Both end portions 208*a* and 208*b* of the plate spring 208 are contacted with and supported by the both end portions 200*a* and 200*b* of spring-bearing surface 200, respectively, and thus the plate spring is mounted on the face 200 by means of screw 206. The screw 206 for fixing the spring is screwed into the body 201 and part of the screw is projected through the body and connected with dial 209 for adjusting the taper. By rotating dial 209, the taper angle of the pencil-bearing surface can simply be adjusted to an appropriate angle by bending or curving the plate spring 208, as seen in FIG. 49. Thus the contact of the blade with the wood and the lead of a pencil can be adjusted to an appropriate condition so that the soft wood portion and the hard lead portion of a pencil can be shaved smoothly and the pencil can be sharpened beautifully. The screw 206 for fixing the spring functions also as a screw for adjusting the taper angle of the bore. The means for rotating the screw should not be limited to a dial type one. Any means can be applied as long as it can rotate the screw in a simple manner. Further, the recess 200*c* of the spring-bearing surface 200 may take any form or structure so long as it can make the spring 208 adjustable. The means for bending and reinstituting the spring 208 should not be limited to a screw. Any other means can also be applied so long as it is effective to the same extent as in the screw. The mechanism of the Example as mentioned above can effectively be applied to a spiral cutter type pencil-sharpener.

The present invention has been described in accordance with the above examples. The slit in the present invention can take a groove (recess) configuration, besides the shown cutout configuration, and the body of the pencil sharpener may be formed so as to partially have thin side walls, whereby the effective circumference of the pencil-insertion bore on the rear side of the body can be reduced or enlarged by pressing or releasing the thin-wall portions of the body. In this case, a soft plastic material is usually employed.

As understood from the above, the slit with regard to the present invention can be provided in the pencil sharpener having at least a blade (any blade means such as a plate blade or a spiral cutter is acceptable) and the pencil-insertion bore to prepare the constitution capable of fastening and releasing the body.

In the present invention, the position to provide a slit in the body is not particularly limited. This is apparent from the fact that the eleventh and fifteenth examples are about the same in functional effects.

Further, into the slit there may be inserted an elastic material (a rubber packing or the like). If such a structure is taken, the slit will not be clogged with pencil shavings. Even if no elastic material is inserted thereinto, any disadvantage will not occur virtually, because clogged shavings have no influence on the above adjustment, and they themselves serve as elastic packings.

The screw for adjusting the taper angle of the pencil-insertion bore may be disposed at any position, so long as it is easily usable, because even if the screw is disposed at any position, the effective circumference alone on the rear side of the body can be reduced or enlarged without change in the diameter of the pencil-insertion bore on the front side of the body.

In examples of the present invention, the dial is used as a means for rotating the screw for taper adjustment, but it is not limited to such a dial type. Any rotating means can be employed, so long as it can be readily rotated without using a screw driver or the like.

As a means for adjusting the taper angle of the blade or the pencil-insertion bore, the above examples suggest the screw, but it is not limited to the screw. The reason why the screw is used is that it is simplest in structure and can do a fine adjustment by a slight rotating operation. Therefore, any means, for example, a cam mechanism may be used, so long as it has about the same convenience as the screw. The screw for adjusting a taper may firmly be secured after it has been adjusted to the position where the best cut surface can be obtained, or the screw may be on the market in a rotatable condition so that a user can adjust it.

Reference has been made to examples with regard to the present invention, but the invention is not limited to these examples, and there are a variety of modified constitutions such as a combination of the above examples to permit an extremely fine adjustment of the blade or the pencil-insertion bore.

Constitutional alteration of the blade or the pencil-insertion bore by the taper adjustment thereof is very minute, if any, but the drawings exhibit the alteration with exaggeration for better comprehension.

As is apparent from the above, a taper angle of the blade with respect to the taper of the pencil-insertion bore, or a taper angle of the pencil-insertion bore with respect to the taper of the blade can be adjusted so that the blade may bite into the lead of the pencil more shallowly than the wood thereof and most shallowly at the position where the lead top is sited, whereby the wood and the lead can be sharpened simultaneously by the use of the plane blade with result that the lead of the pencil is pointed finely and accurately. When a sharpening operation of the pencil has been completed, the blade stops bitting into the cut surface of the pencil, whereby the over-sharpening of a pencil can be prevented. The taper adjustment of the blade or the pencil-insertion bore can be carried out easily by a user. Even a worn blade which has a poor sharpening ability can be used for a long period of time, and since having the simple structure, the pencil sharpener according to the present invention can be manufactured at low cost.

Further, the pencil sharpener according to the present invention in which the two divided portions of the body can be separated or closed has a variety of functions simultaneously, in spite of an extremely simple structure. That is to say, in the first place, accurate sharpening of the wood and the lead of the pencil can be carried out simultaneously by the use of one blade, and at the time of completion of the sharpening operation, the cutting of the blade into the cut surface of the pencil is stopped, whereby the over-sharpening of the pencil can be prevented. As a means for adjusting the taper angle of the pencil-insertion bore, for example, a dial type screw can be used, whereby the lead having a desired thickness can be obtained. Further, according to the present invention, the tip of the lead can be pointed beautifully, if desired. Furthermore, even the blade which is degraded by abrasion can provide a good cut surface of the pencil during a relatively long period of time. Additionally, the pencil sharpener according to the present invention which has a high performance considering a simple structure can be manufactured at low cost.

I claim:

1. A pencil sharpener comprising:

a body having a tapered pencil-insertion bore therein, said pencil-insertion bore having a longitudinal axis;

a cutting blade means mounted to said body and disposed to form a cutting slit along the longitudinal direction of said pencil-insertion bore;

said pencil-insertion bore being adapted to receive a pencil therein for sharpening against said cutting blade means;

means forming an adjustable width regulating slit in said body along said pencil-insertion bore and spaced from said cutting slit in the circumferential direction of said pencil-insertion bore; and means coupled to said body for adjusting the width of said adjustable regulating slit to thereby adjust the taper of said pencil-insertion bore.

2. The pencil sharpener of claim 1, wherein said body has a front side in the vicinity of the wider portion of said tapered pencil-insertion bore and a rear side in the vicinity of the narrower portion of said tapered pencil-insertion bore, said adjustable width regulating slit being formed at least at the rear side of said body along said pencil-insertion bore.

3. The pencil sharpener of claim 2, wherein said cutting blade means comprises a plane cutting blade.

4. The pencil sharpener of claim 1, wherein said cutting blade means comprises a plane cutting blade.

5. The pencil sharpener of claim 2, wherein said cutting blade means comprises a rotatable cutting member disposed to form said cutting slit along said longitudinal direction of said pencil-insertion bore.

6. The pencil sharpener of claim 1, wherein said cutting blade means comprises a rotatable cutting member disposed to form said cutting slit along said longitudinal direction of said pencil-insertion bore.

7. The pencil sharpener of claim 1, wherein said means forming said adjustable width regulating slit comprises a leaf spring member mounted to said body and extending along the longitudinal direction of said pencil-insertion bore, said body having a space provided below said leaf spring, and comprising means for adjusting the width of said space between said leaf spring and said body for adjusting the taper angle of said pencil-insertion bore.

8. The pencil sharpener of claim 7, wherein said body comprises means at opposite ends of said leaf spring for supporting said leaf spring above said space, the central portion of said leaf spring being arranged over said space.

9. The pencil sharpener of claim 8, wherein said means for regulating the width of said space between said leaf spring and said body comprises screw means engaged with a central portion of said leaf spring for selectively pressing said central portion of said leaf spring toward said body to selectively regulate the width of said space.

10. The pencil sharpener of claim 7, wherein said leaf spring is provided at the side of said cutting slit which is opposite to the side on which said cutting blade is mounted, an edge of said leaf spring being adjacent said cutting slit.

11. The pencil sharpener of claim 10, wherein said cutting blade means and said leaf spring are arranged adjacent each other on the same side of said body, said cutting slit being arranged between said cutting blade means and said leaf spring.

12. The pencil sharpener of claim 7, wherein said leaf spring comprises a cantilever spring member extending along the longitudinal direction of said tapered pencil-insertion bore.

13. The pencil sharpener of claim 12, wherein said leaf spring member is integrally formed with said body, and wherein said means for adjusting the width of said space comprises means in the vicinity of a free end of said leaf spring for adjusting the width of said space between said leaf spring and said body.

14. The pencil sharpener of claim 13, wherein said adjusting means comprises a scew member engaged with said free end portion of said leaf spring and with said body.

15. The pencil sharpener of claim 1, wherein said means forming said adjustable width regulating slit comprises means defining an elongated opening in said body and extending along the longitudinal direction of said pencil-insertion bore, and means for adjusting the width of said opening in the circumferential direction of said bore for thereby adjusting the taper angle of said pencil-insertion bore.

16. The pencil sharpener of claim 15, wherein said elongated opening extends from said rear side of said body to a portion thereof interior of said rear side.

17. The pencil sharpener of claim 15, wherein said elongated opening extends from a portion of said body adjacent to and spaced from said rear side of said body and extends toward said front side of said body.

18. The pencil sharpener of claim 17, wherein said elongated opening extends along said longitudinal pencil-insertion bore and terminates spaced from said front side of said body, the elongated opening not extending to said front and rear sides of said body.

19. The pencil sharpener of claim 16, wherein said means for adjusting the width of said opening comprises a screw member threadably engaged with said body on one side of said elongated opening, and bearing against a portion of said body on the other side of said elongated opening, said screw member being turnable to thread same into said body to press portions of said body on opposite sides of said opening together to thereby adjust the width of said opening.

20. The pencil sharpener of claim 17, wherein said means for adjusting the width of said opening comprises a screw member threadably engaged with said body on one side of said elongated opening, and bearing against a portion of said body on the other side of said elongated opening, said screw member being turnable to thread same into said body to press portions of said body on opposite sides of said opening together to thereby adjust the width of said opening.

* * * * *

UNITED STATES PATENT AND TRADEMARK OFFICE

CERTIFICATE OF CORRECTION

PATENT NO. : 4,506,716

DATED : March 26, 1985

INVENTOR(S) : Hiroo HAYASHI

It is certified that error appears in the above-identified patent and that said Letters Patent is hereby corrected as shown below:

On the initial page of the patent, in the heading thereof, change the inventor's first name from "Hirro" to --Hiroo--.

Column 1, line 6, after "including a blade," insert --and--.

Signed and Sealed this

*Third* Day of *June 1986*

[SEAL]

*Attest:*

DONALD J. QUIGG

*Attesting Officer*

*Commissioner of Patents and Trademarks*